United States Patent [19]

Rhodes

[11] 4,145,783

[45] Mar. 27, 1979

[54] WATER WINDOW

[76] Inventor: Ronald J. Rhodes, 18444 Lenore, Detroit, Mich. 48219

[21] Appl. No.: 825,649

[22] Filed: Aug. 18, 1977

[51] Int. Cl.[2] ..... A63C 5/00; A63C 9/00; A63C 11/00; A63C 15/00

[52] U.S. Cl. ..... 9/310 H; 114/66

[58] Field of Search ..... 350/276, 319; 114/66, 114/68, 267; 9/1.3, 310 R, 310 A, 310 M, 311, 312, 313, 400, 347, 8 R, 9

[56] References Cited

U.S. PATENT DOCUMENTS

| | | | |
|---|---|---|---|
| 3,081,726 | 3/1963 | Betts | 114/66 |
| 3,147,498 | 9/1964 | Convis | 9/313 |
| 3,182,340 | 5/1965 | Gentile | 9/8 R |
| 3,340,845 | 9/1967 | Tyrack | 115/70 |
| 3,423,777 | 1/1969 | Feyling | 9/8 R |
| 3,596,082 | 7/1971 | Doret | 350/319 |
| 3,628,853 | 12/1971 | Stoscup | 350/319 |
| 3,808,621 | 5/1974 | French | 9/310 M |

*Primary Examiner*—Trygve M. Blix
*Assistant Examiner*—D. W. Keen
*Attorney, Agent, or Firm*—Krass & Young

[57] ABSTRACT

An underwater viewing device for use by a person standing in relatively shallow water and comprising a central transparent viewing window peripherally surrounded by a support structure which maintains the window parallel with and slightly beneath the surface of the water. A light affecting element is disposed within the structure adjacent the window. The support structure houses one or more storage compartments and a flotation ring which buoys and trims the viewing device while floating in the water. Fishnet covers enclose the compartments to prevent spillage of their contents. A light within the support structure permits night use.

10 Claims, 5 Drawing Figures

WATER WINDOW

INTRODUCTION

The present invention relates to aquatic viewing devices and specifically to buoyant self-trimming viewers for use in observing and gathering articles which are under water.

BACKGROUND OF THE INVENTION

Prior art devices which aid in the observation and retrieval of underwater objects typically fall into two broad categories. Within the first category is the individual viewer such as the well-known face mask or goggles. Although being highly portable, these devices are generally not buoyant and are easily lost. Moreover, masks and goggles require the user to place his head in the water. Another individual viewer is disclosed in U.S. Pat. Nos. 2,712,139 and 2,717,399 and comprises an inflatable or buoyant foam paddle board having a window mounted near one end. Although the windowboard cures some of the problems associated with masks and goggles, it requires the user to lay on it. Moreover, it does not provide any kind of storage facility.

A second type of underwater viewing device known in the prior art is exemplified by a glass bottom excursion boat which has the advantage of facilitating a number of users. This type of device is too large, burdensome and expensive a device for use by one or two individuals. Although a device of this type allows the users to sit or stand substantially in the upright position, the user is typically restricted to observation only and cannot use the device for actual collection of underwater objects.

BRIEF DESCRIPTION OF THE INVENTION

An object of the present invention is to provide an underwater viewing device which is highly portable and maneuverable, is buoyant, self-trimming and can be used by one or more people simultaneously whose bodies are substantially in the upright position and whose eyes are not in a fixed relationship with the viewing window. In general, this is accomplished by a water window having a central viewing window surrounded by a support member which, in combination with the window, forms an open-topped, water-tight chamber. The support structure projects above the surface of the water and positions the viewing window substantially parallel with and slightly beneath the surface of the water. A flotation device surrounds at least a portion of the viewing window at or near the water line to provide buoyancy as well as trimming for the device, even if it should happen to become swamped, overturned or unevenly loaded. Incorporated within the support structure is a storage compartment suitable for receiving collectables such as rocks, shells and the like or holding tools, spare parts and the like.

In a specific embodiment of the invention, handles are incorporated within the support structure to project outwardly for maneuvering the device in the water with one or both hands. Additionally, when being transported, the handles permit the device to be carried vertically like a suitcase, which is particularly important when storing relatively heavy rocks, tools or the like. The viewing window, support structure and handles are integrally formed of acrylic plastic or the like. This provides a lightweight, inexpensive unit which is extremely sound structurally.

In the preferred device, the viewing window is in the center surrounded by a number of arcuate storage compartments. With this arrangement, the viewing device can receive a large number of objects within the compartments and still remain trim. The flotation device is an annular ring of expanded synthetic resinous material such as that sold under the trademark "STYROFOAM" which is located beneath the storage compartments and adjacent the periphery of the viewing port. Two laterally opposed handles are provided to permit one person to carry the device vertically or two people to carry the device horizontally between them. Preferably, the diameter of the supporting structure is such that one person can easily maneuver and carry the device.

Also included in the preferred embodiment are elastic fishnet compartment covers which prevent spillage of the compartment contents should the viewing device be overturned in the water or dropped during transportation. Fishnet is preferred because of its extremely low cost, light weight and its property of allowing the user to view the contents of the compartment at any time. The fishnet is secured to the support structure along the perimeter of the compartment opening with a plurality of corresponding nibs and loops. For access to the compartment one merely unhooks two or more adjacent loops, inserts a single finger within the fishnet and stretches it radially outwardly.

A light affecting element such as a polarized grid, filter, wide angle lens or magnifying lens may be located within the viewing chamber adjacent the window. Alternatively, the lens and window may be integrally combined.

Still another feature of the preferred embodiment is a light which is incorporated within the support structure and functions to project a beam of light downwardly. The compartment containing the light is watertight. A light reflector projects light downwardly and away from the user so that, for example, a user walking in waist deep water at night would have a well-lit area immediately before him.

Various other features and advantages of this invention will become apparent upon a reading of the following specification, which taken with the drawings, describes and discloses a preferred illustrative embodiment of the invention in detail.

DETAILED DESCRIPTION OF THE INVENTION

Figures 1, 2, 3, 4, 5:
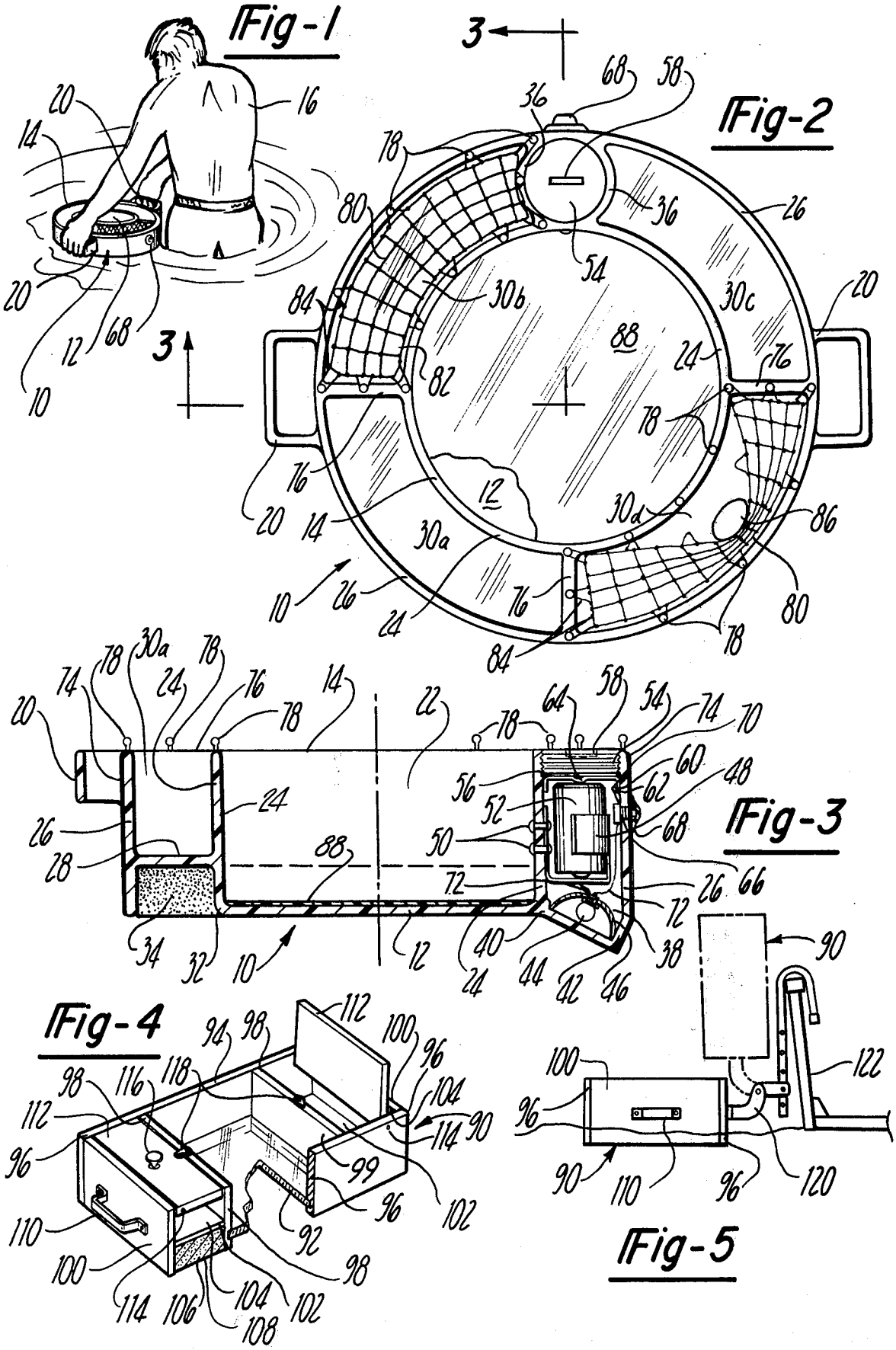
FIG. 1 is a perspective view of the preferred embodiment of the invention in application.
FIG. 2 is a cut-away top plan view of the preferred embodiment of the invention.
FIG. 3 is a folded side sectional view of the preferred embodiment of the invention as illustrated in FIG. 2.
FIG. 4 is a cut-away perspective view of an alternative embodiment of the invention.
FIG. 5 is a partial section plan view of the alternative embodiment of the invention illustrated in FIG. 4 in application.

Referring to FIG. 1, a preferred embodiment of the invention is shown in application. An underwater viewer 10 comprises a central viewing window 12 which is peripherally surrounded by support structure 14 by being sealingly mounted in a central opening. The window 12 is substantially transparent, allowing a user 16 to look downwardly through it into the water. The user 16 is standing upright in the water which can be anywhere from ankle to chest deep. It is contemplated that the user could also use the device sitting on a boat, raft, dock or the like. The viewing device 10 has two laterally opposed integral handles 20 connected to the radially outwardmost surface of the structure 14. The viewing device 10 is used by grasping the handles 20 with one or both hands and sweeping the device in a reciprocating manner from right to left back to right in front of the user 16. While maneuvering the device 10 in such a manner, the user 16 walks through the water in a line substantially parallel with the shore. With this method, a relatively large underwater area may be observed in a short period of time.

Although the underwater viewing device illustrated in FIG. 1 is primarily intended for use for rock and shell collectors, it is contemplated that it could be employed for many other applications such as recreational underwater viewing or the recovery of articles which have dropped into the water near the beach, off a dock, boat or the like.

Referring to FIGS. 2 and 3, the preferred embodiment of the invention is shown in detail. The viewing device comprises a circular transparent viewing window 12 integral with and surrounded by support structure 14 mounted at the lowermost region thereof as shown. The structure 14 encloses the entire periphery of the viewing port 12, thus defining a cylindrical chamber 22 which is open at the top. Although the specific dimensions of the device 10 are not critical, the support structure 14 should be high enough to prevent water from splashing onto the top of the window 12, but not so high as to obstruct vision of the user 18 who is looking downwardly, often at an angle, into the viewing chamber 22. The device 10 has two laterally opposed outwardly projecting handles 20. The viewing port 12, support structure 14 and handles 20 are all formed from a single integral molded piece of transparent acrylic plastic. Such a unit is extremely lightweight, strong and relatively inexpensive to manufacture.

The support structure 14 includes a cylindrical inner ring 24 and cylindrical outer ring 26, the two rings 24 and 26 being radially spaced apart by a horizontal spacer web 28. The handles 20 are integrally molded to the outermost surface of the outer ring 26. The buttommost portion of the inner ring 24 is integral with the window 12. Web 28 divides the annular volume between rings 24 and 26 into upper and lower portions 30 and 32, respectively. Upper portion 30 is subdivided by partitions 76 to receive and store articles which are associated with the usage of the viewing device 10. It is contemplated that the viewing chamber 22 can also be used as a storage compartment. Lower portion 32 receives a ring 34 of expanded synthetic resinous material to trim the viewing device when it floats in the water, even when relatively heavy articles are contained within the storage compartment 30.

Two arcuate partitions 36 combine with the inner and outer rings 24 and 26, respectively at a point 90° opposed from the handles 20 to form a vertically oriented cylindrical cavity 38. Cylindrical cavity 38 is closed at the bottom by a transparent lens 40 and a dogleg portion 42. The lens 40 is substantially planar and angularly offset from the plane defined by the window 12 by approximately 30° whereby a line projected normally to lens 40 will direct downwardly and inwardly with respect to the viewer 10. The dogleg 42 interconnects the outermost edge of the lens 40 and the lowermost edge of outer ring 26. The innermost edge of diffuser 40 joins the common point of the window 12 and the inner ring 24. Within the cylindrical cavity 38 is a light source 44 which is electrically and mechanically positioned in the focal point of a parabolic reflector 46. The reflector 46 opens downwardly and inwardly. A metal bracket 48 is contained within cavity 38 and is affixed to the inside ring 24 by rivets 50. It is contemplated that other attachment means can be substituted. The bracket 48 embraces a standard dry cell battery 52. The lower terminal of battery 52 makes electrical contact with the bracket 48. Within the cavity 38, the uppermost part of inner and outer rings 24 and 26, respectively, as well as partitions 36 are threaded to receive a mating screw-on cap 54. Cap 54 is of molded plastic or the like. The lower most part of the cap 54 has an integral circular groove to receive a rubber O-ring 56 which, in assembly, is under a slight compression fit with the walls of the cylindrical cavity 38. Thus, when cap 54 is in place, a substantially water-tight compartment is formed thereby. An upwardly opening slot 58 in the screw cap 54 allows removal of the cap with a coin, screwdriver, pocket knife or the like. A circular metallic contact 60 is affixed to the screw top 54. The contact 60 has a peripheral downward turned leg 62 which is of slightly lesser outside diameter than the cylindrical cavity 38 inside diameter. When the top 54 is threaded into the cylindrical cavity 38, a dimple 64 in the contact 60 makes electrical contact with the upper terminal of battery 52. A "push-on-push-off" ratchet type switch 66 is mounted to the outside ring 26 of the viewer 10. A flexible rubber boot 68 covers the switch 66 thereby keeping the compartment 38 substantially watertight while allowing external switching of the light circuit. The switch 66 has an upwardly projecting leaf spring terminal 70 which comes into contact with the downward turned leg 62 of contact 60 when the cap 54 is fully threaded onto the device 10. Electrical wires 72 complete a simple series circuit of the switch 66, contacts 44 and 48, battery 52 and light source 44.

In the application illustrated in FIG. 1, the switch 66 is pointed toward the user 16 for ready access thereto. When viewing underwater at night, one need merely turn switch 66 on, thereby activating the light source 44. The orientation of the reflector 46 compensates for any parallax between the viewer's eyes, the viewing window 12 and the underwater object which is being viewed. The light source 44 projects light directly downwardly and forwardly of the viewer 10 to fully illuminate the user's field of vision.

To prevent light reflection during daylight use, the outsidemost surface of the outer leg 26 is covered with an opaque coating 74 such as paint or the like. It is contemplated, however, that the entire viewer with the exception of the window 12 and the lens 40 could be molded of an opaque material and the window 12 and lens 14 be separately molded of transparent material and affixed thereto.

A light affecting element 88 is disposed within the viewing chamber 22 adjacent the upper surface of the window 12. The element 88 functions to screen, filter and/or redirect the light passing through the window 12. In one configuration, the element 88 comprises a polarized grid overlaying the upper surface of the window 12 to eliminate glare from the sun. In another, the element 88 comprises a tinted translucent filter which enhances or retards selected colors. The light affecting element 88 can, alternatively be lens-shaped and integrally combined with the window 12 to provide a wide angle or magnifying viewer. Additionally it is contemplated that the window 12 can be segmented to take advantage of two or more of these features.

Three radially oriented vertical partitions 76 interconnect the inner and other rings 24 and 26 of the structure 14. Partitions 76 are integrally molded with the rings and are angularly spaced 90° from one another as well as from the arcuate partitions 36. Thus, the storage compartment 30 is partitioned into four separate compartments $30_a$, $30_b$, $30_c$ and $30_d$. Although four compartments are illustrated, it is contemplated that virtually any number could be provided. Having separate or partitioned compartments permits load balancing as well as on-the-spot sorting of rocks, shells and the like. A number of bulb topped nibs 78 project upwardly from the uppermost edge of the inner and outer rings 24 and 26 as well as the partitions 36 and 76. These nibs 78 provide retention points for elastic fishnet screens 80 which closure means for selectively covering the storage compartment openings. The fishnet cover is constructed of nylon thread forming a net assembly having a plurality of elastic loops 84 around the periphery thereof. In application, the loops 84 are positioned over respective nibs 78. The storage compartments 30 are thus closed to prevent spillage of the contents should the viewer overturn, be dropped, or be carried vertically. The fishnet construction of the cover 80 provides an effective lightweight closure means which allows the user to view the contents at all times. To gain access to the storage compartment 30, the user need merely remove several adjacent loops 84 from their respective nibs and, with a finger 86, stretch the cover 80 radially outwardly.

Referring to FIGS. 4 and 5, an alternative embodiment of the invention is illustrated. A viewing device 90 of relatively heavy construction comprises a central transparent viewing window 92 which is peripherally surrounded by a rigid opaque upstanding structure 94 such as wood. The upstanding structure 94 comprises two elongated side members 96 which are spaced apart by the viewing window 92, two inner end members 98 and two outer end members 100. A viewing chamber 99 is defined by the insidemost surfaces of the central portion of side members 96, the inner end members 98 and the uppermost surface of the viewing window 92. The inner and outer end members 98 and 100, respectively, are spaced apart by substantially horizontal spacing members 102.

Above the uppermost surface of each spacing member 102 is an upwardly opening storage compartment 104 and below the lowermost surface of each spacing member 102 is a flotation chamber 106. The flotation chambers 106 receive flotation devices 108 such as blocks of expanded synthetic resinous material. It is contemplated that both the structure 94 and flotation devices 108 could be composed of a suitable buoyant homogeneous material. Additionally, the flotation chambers could be sealed to form air-tight chambers. The compartment structure at each end is identical and a thorough description of one will suffice. Laterally opposed handles 110 are affixed to the outwardmost surface of the outer end members 100. The storage compartments 104 are closed by closure means comprising compartment covers 112 which are pivotally attached to the members 96 by dowel pins 114 or the like. A compartment cover opening knob 116 is affixed to the uppermost surface of the compartment tops 112. Cam shaped latches 118 are pivotally secured to the inner end members 98 to secure the compartments tops in the closed position. When the viewing device 90 is used for fishing, boat repair or general observation from a boat, dock, raft or the like, a suitable pivotable retention bracket 120 is provided to permit the device 90 to float in the water alongside the boat 112. When not in use, the device 90 is pivoted upwardly out of the water.

The alternative configuration of the invention illustrated in FIGS. 4 and 5 is intended for use around boats, piers and the like where relatively heavy tools or fishing tackle are employed.

Although the exact size and shape are not critical, the viewer should be large enough to permit a relatively wide field of vision through the viewing port and the storage of a sufficient number of articles for the application, but small enough to be maneuvered easily with one or two hands, as well as carried to and from the water. Although the invention as disclosed is intended for use by serious minded rock and shell collectors, as well as boaters and fishermen, it is contemplated that the viewing device could be used as a recreational toy in a swimming pool or the like. An additional application could be found with the addition of a mirror directly beneath the viewing port. With this arrangement, the user could look downwardly through the viewing port and onto the reflection in the mirror of the boat bottom. This would be particularly important in a situation where a boat propeller or rudder became fouled with a foreign object.

Although the weight is not critical, however, the device must be light enough to facilitate its use and transportation, yet heavy enough to place the viewing port slightly beneath the surface of the water to prevent bubbles, foam and the like from obscuring the user's vision. Additionally, it is essential that the floatation device adequately buoy and trim the viewer and the materials within the storage compartments in the event the user releases the viewer to float independently and reaches beneath the surface for any reason.

It is to be understood that the invention has been described with reference to specific embodiments which provide the features and advantages as previously described and that such specific embodiments are susceptible of modification as will be apparent to those skilled in the art. Accordingly, the foregoing description is not to be construed in a limiting sense.

The embodiments of the invention in which an exclusive property or privilege is claimed are defined as follows:

1. A hand guided underwater viewing device comprising:

a substantially transparent viewing window;

a peripheral support structure having a central opening receiving said viewing window, said viewing window being mounted and sealed therein at the bottommost region of said support structure to define an open-topped, water tight viewing chamber which, in application within a body of water, positions said viewing window substantially parallel with and slightly beneath the surface of the water;

flotation means peripherally surrounding at least a portion of said viewing window and secured to the lowermost region of said support structure to buoy and trim said viewing device;

and at least one upwardly opening storage compartment formed within said support structure for the accumulation of collectables and the like, said storage compartment being positioned in said flotation means mediate and contiguous to an outwardmost wall on said support structure and the wall of said central opening;

closure means associated with said at least one storage compartment allowing selective opening and closing thereof to obtain access to said storage compartment and closure thereof to retain said collectables; and at least one radially outwardly directed handle attached to the outwardmost surface of said support structure, whereby said device can be maneuvered within the water and, alternatively, be carried in a substantially vertical orientation during the transportation thereof with said collectables retained within said at least one storage compartment by said closure means.

2. Apparatus as described in claim 1 wherein said viewing port, supportive structure, storage compartment and handle are integrally formed of molded plastic.

3. Apparatus as described in claim 1 wherein said closure means is substantially transparent.

4. Apparatus as described in claim 1 further comprising a substantially transparent light affecting element disposed within said viewing chamber adjacent said viewing window.

5. Apparatus as described in claim 4 wherein said light affecting element is a polarized grid.

6. Apparatus as described in claim 4 wherein said light affecting element is a magnifying lens.

7. Apparatus as described in claim 4 wherein said light affecting element is a wide angle lens.

8. Apparatus as described in claim 4 wherein said light affecting element is a tinted translucent filter.

9. Apparatus as described in claim 1 further comprising a light source within said support structure, the light from said source being directed substantially downwardly from said viewing device.

10. Apparatus as described in claim 1 wherein said flotation means is an annular ring of expanded synthetic resinous material.

* * * * *